US005779233A

United States Patent [19]

Schweiger

[11] Patent Number: 5,779,233

[45] Date of Patent: Jul. 14, 1998

[54] DEVICE AND METHOD FOR COMBINING AND PROCESSING SEVERAL PAPER WEBS

[75] Inventor: Joseph Schweiger, Vaduz, Liechtenstein

[73] Assignee: Branstal Printing Participation Establishment, Vaduz, Liechtenstein

[21] Appl. No.: 727,402

[22] PCT Filed: Apr. 13, 1995

[86] PCT No.: PCT/EP95/01402

§ 371 Date: Oct. 15, 1996

§ 102(e) Date: Oct. 15, 1996

[87] PCT Pub. No.: WO95/28345

PCT Pub. Date: Oct. 26, 1995

[30] Foreign Application Priority Data

Apr. 13, 1994 [CH] Switzerland ..... 1099/94

[51] Int. Cl.[6] ..... B65H 39/00

[52] U.S. Cl. ..... 270/52.07

[58] Field of Search ..... 220/52.07, 52.08

[56] References Cited

U.S. PATENT DOCUMENTS

| | | | |
|---|---|---|---|
| 3,097,844 | 7/1963 | Huck . | |
| 4,425,694 | 1/1984 | Somerville . | |
| 4,570,916 | 2/1986 | Thompson | 270/52.08 |
| 5,048,810 | 9/1991 | Palmatier et al. | 270/52.08 |
| 5,104,104 | 4/1992 | Mol | 270/52.08 |
| 5,117,610 | 6/1992 | Hartman et al. | 270/52.07 X |

FOREIGN PATENT DOCUMENTS

| | | |
|---|---|---|
| A-33-23-819 | 1/1985 | Germany . |
| U-93-13-481 | 1/1994 | Germany . |
| 58-220039 | 12/1983 | Japan . |
| 637131 | 5/1950 | United Kingdom . |

*Primary Examiner*—Hoang Nguyen
*Attorney, Agent, or Firm*—Oliff & Berridge, PLC

[57] ABSTRACT

A device for combining and processing at least two paper or foil webs includes at least two pay-out units (1*a*, 1*b*, 1*c*), in each of which a paper web (3*a*, 3*b*, 3*c*) provided with markings applied at regular intervals is pulled off by withdrawal rolls (7*a*, 8*a*, 7*b*, 8*b*, 7*c*, 8*c*) from a roll (2*a*, 2*b*, 2*c*) and, possibly guided over deflection rollers (13*a*, 13*b*, 13*c*), is combined with the at least second paper web (3*a*, 3*b*, 3*c*) and fed to a processing line (11). In processing line (11) preferably the at least two paper webs (3*a*, 3*b*, 3*c*), possibly independent of one another, pass through processing units and are supplied to a unit (15) for further processing. Means are provided for congruent longitudinal register control of the at least two paper webs (3*a*, 3*b*, 3*c*), said means comprising means for producing a paper tension that is essentially the same for each of the at least two paper webs (3*a*, 3*b*, 3*c*), over the width of the respective paper web, web feelers (18, 17*a*, 17*b*, 17*c*) for registering the time sequence of the markings on each paper web (3*a*, 3*b*, 3*c*), and a control unit (19) for controlling a drive or brake device. Withdrawal rolls, especially in the form of rubber rolls (14*a*, 14*b*), are provided as means for developing paper tension, said rolls being located downstream of processing line (11) and preferably directly upstream of unit (15) for further processing.

12 Claims, 4 Drawing Sheets

DEVICE AND METHOD FOR COMBINING AND PROCESSING SEVERAL PAPER WEBS

Figure 1:
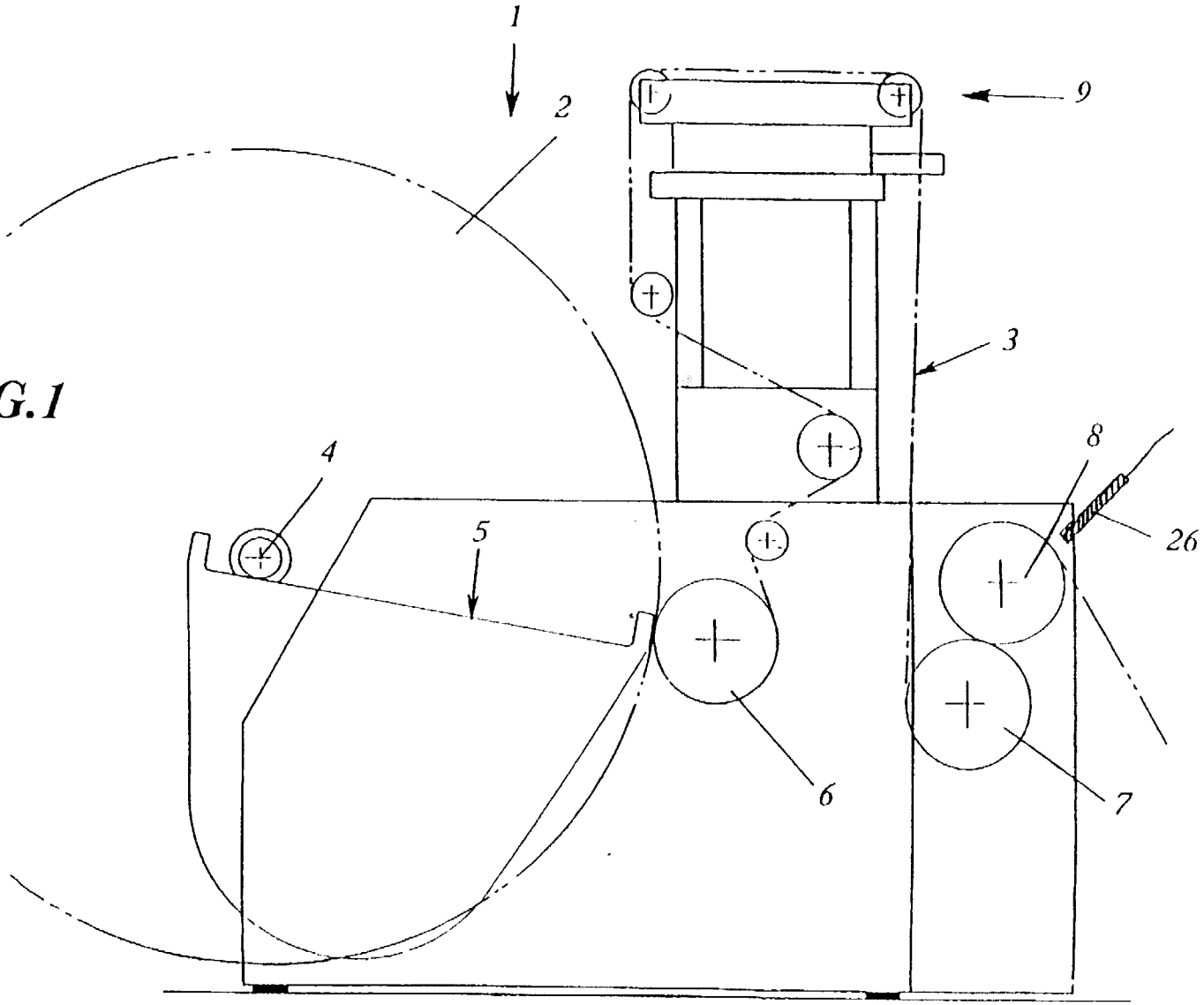

The invention relates to a device for combining and processing several paper webs according to the preamble of claim 1, as well as a method for combining and processing several paper webs.

The expression "processing of a paper web" in the broadest sense of the term is understood to be any form of processing, be it printing, laminating, numbering, perforating, or punching, and the application or provision (by gluing) of plastic cards such as credit cards, with sample pouches, labels, or the production of address windows and their covering by transparent foils.

When an individual endless paper web is processed with synchronization of the basic processes, fault-free finishing of said web, such as folding or cross-cutting, depends uniquely on proper maintenance of web speed. This is accomplished for example by registration holes being provided on the paper web and with toothed belts, located along the finishing or processing line, engaging said holes, thus ensuring a synchronous feed of the paper web. This type of longitudinal register control however has the disadvantage that firstly this perforated edge must generally be removed in the unit for further processing and secondly this bilateral perforated edge means loss of material that has a high value in itself.

In a known device, this disadvantage is overcome by providing the paper web with markings that are registered by a web feeler. This feeler is located upstream of the unit for further processing. In this way, with appropriate control, further processing in register, such as printing, embossing, stamping or cutting of webs that have already been processed, preprinted for example, is made possible. This control regulates the drive of the pay-out rollers on the pay-out unit, by which the format length can be influenced. Alternatively, the register can also be corrected using a synchronous motor that influences the drive of the feed rollers located upstream from the unit for further processing.

The situation is completely different however when it is desired not only to process and finish a web, a requirement which arises for example when printing newspapers, but several webs must be processed, possibly in different ways, for example, glued-in sample packs or removable reply cards. Thus far, no satisfactory solutions have been found for these. Of course it is possible to guide all the paper webs using toothed belts but this would not allow independent processing of individual webs. The other device described above could be used for a paper web but not for a plurality of webs guided in common, one above the other for example, and then possibly processed independently and possibly are webs of different quality or with different processing (application, for example).

Hence the goal of the invention is to provide a device and a method by which several paper webs are brought together and processed (possibly independently of one another), and then, correctly registered longitudinally, can be fed jointly to a unit for further processing. One way of achieving this goal is by combining the features of claim 1 and/or claim 8. Advantageous embodiments are described in the dependent claims.

The term "paper webs" according to the invention refers to all materials provided in the form of a web that are possibly subjected to a processing procedure, which in any event are combined with other webs, and which are then subjected to further processing jointly with these other webs. Thus for example it includes foil webs, including thin cardboard webs and paper webs of different thicknesses and qualities.

The term "combination" of the individual paper webs refers to the joint arrangement of the already-unrolled paper webs (possibly at a distance from one another) before they pass through the processing line where they are possibly processed independently of one another or are not processed at all, in other words, they possibly travel different paths. Thus it is possible according to the invention for one of the webs to pass through the processing line without being processed while another web is guided over deflection rollers and subjected to finishing processes. In the same way, however, all webs can be processed simultaneously in a processing unit, crimped or numbered for example.

For congruent longitudinal register control of at least two paper webs, the means comprise means for creating paper tension, which is for each individual paper web equal over its width, however possibly different for the various webs. And it is only due to this provision that the markings applied to the paper webs may be registered through the web feelers in their time sequence in a relevant manner and this registration can be used to regulate the longitudinal register of the at least two paper webs. It is only because the combined webs are under a certain paper tension that differences in the longitudinal register that can occur for example because of the processing in the processing section and which are determined by the register of the markings by the web feelers can be eliminated once again. In addition, a drive or brake device is controlled by a control unit associated in particular with the respective withdrawal rolls, since the latter, as driven rolls, determine the speed of the web.

In order to ensure register-exact processing of the individual webs and their correct common finishing in the unit for further processing through the processing line and on through the individual processing units, means for creating paper tension are provided at least between the processing line and the unit for further processing and since the webs in the unit for further processing are generally no longer under tension, as close as possible upstream from the unit for further processing.

If the means for developing the paper tension are provided as a pair of withdrawal rollers in the form of rubber rolls, because of the relatively flexible surface of the latter, the pressure acting on the paper webs as they are brought together can be distributed more uniformly over the width of the paper web than would be the case for example in known withdrawal rolls, an important requirement for processed webs. If such rubber rolls are provided on their circumferences with a certain profile, the processing products that are applied to the paper web(s) as the paper webs pass through the rubber rolls will be taken up in the matching recesses of the profile, so that the pressure on the paper webs remains constant as they are brought together. Depending on the quality of the paper used, the number of paper webs, and possibly the type of processing of the individual paper webs that is performed in the processing line, instead of a single pair of withdrawal rolls, several of them can be provided in order to ensure a sufficient bond between the individual paper webs and/or to squeeze out any air bubbles that may be present between the paper webs.

If a web feeler, which registers the markings of the uppermost web, is provided in the vicinity of the withdrawal rolls, especially in the vicinity of the last pair of withdrawal rolls in the paper transport direction in the case of several pairs of withdrawal rolls, a guarantee is provided that the further processing that then takes place proceeds with axial longitudinal registration, especially when the unit for further processing abuts the withdrawal rolls as closely as possible. Registration of the markings on the paper webs guided below the uppermost web is accomplished by web feelers located upstream of the processing line, and therefore the longitudinal registration required for individual processing is simultaneously correct as well, and is located especially directly upstream of the combination with the respective upper paper web. A web feeler can also be provided upstream of the processing line for the uppermost web, with information on the correct longitudinal registration of the uppermost web alone being provided, particularly with different processing units in the processing line, in addition to the register information values available from the web feeler located in the vicinity of the withdrawal rolls, said values then being used in particular only for correct registration of the assemblies of the unit for further processing and the assemblies of the processing unit.

The invention will now be described with reference to the drawings.

Figure 2A:
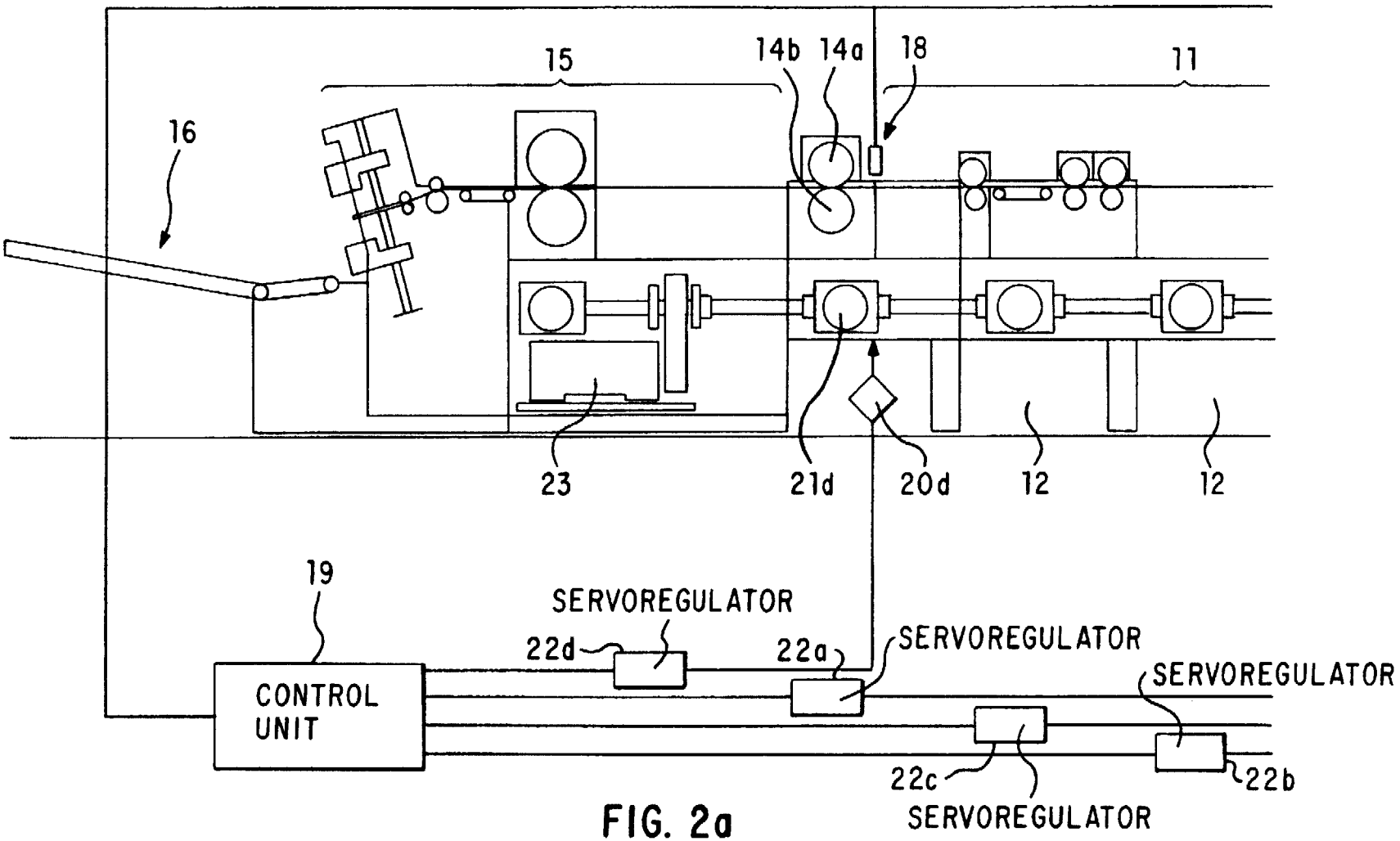
Figure 3A:
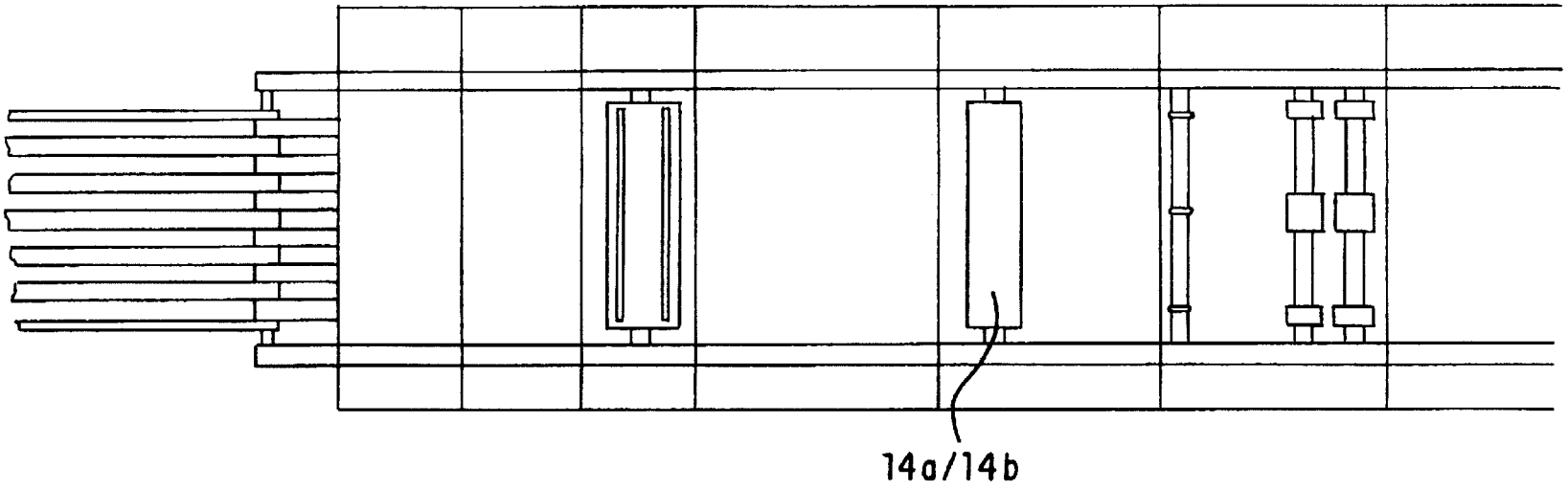
Figure 2B:
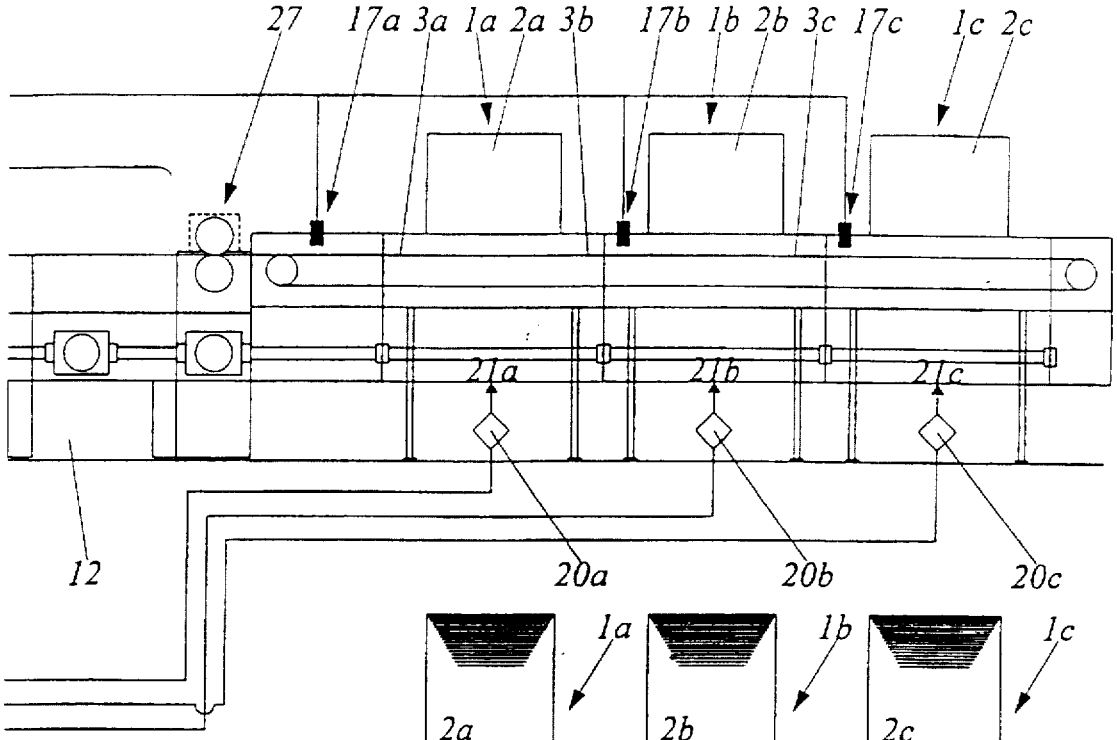
Figure 3B:
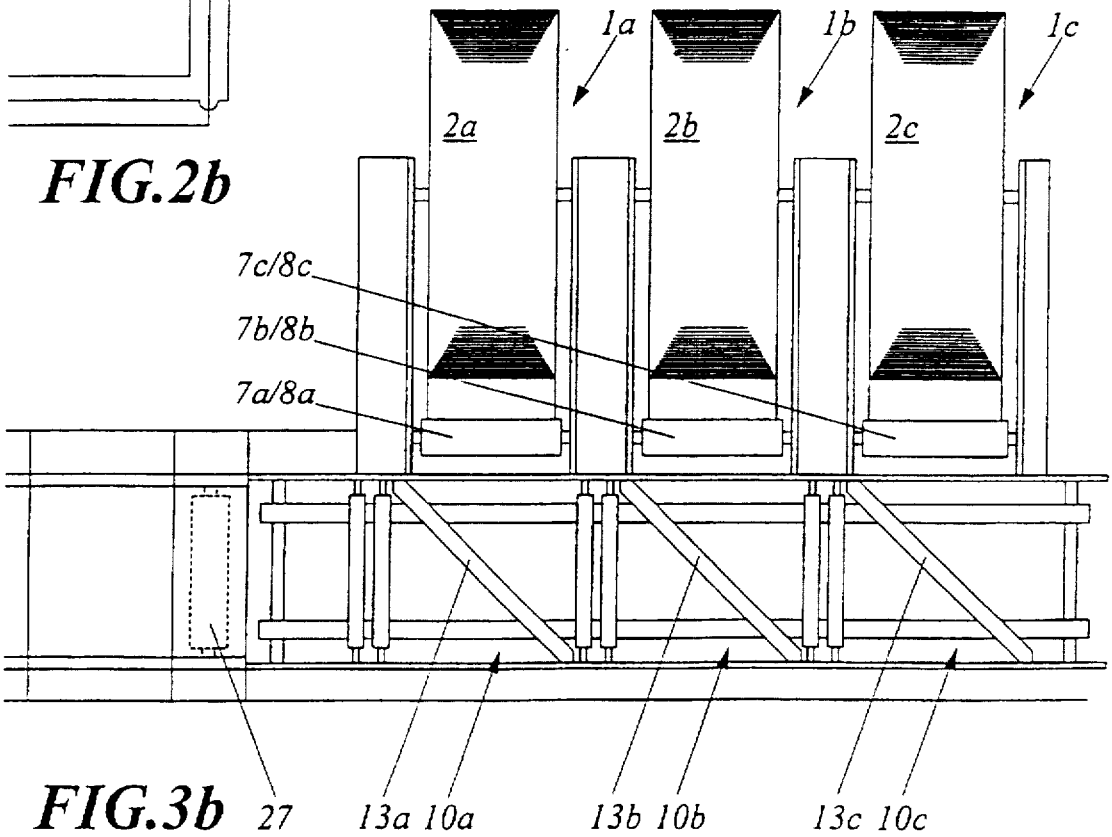

FIG. 1 shows a pay-out unit;

FIGS. 2*a* and 2*b* is a side view of the device according to the invention for combining and processing three paper webs with three pay-out units; and FIGS. 3*a* and 3*b* is a view of the device from above, corresponding to FIG. 2.

FIG. 1 shows a pay-out unit 1 in which a paper web 3 is unrolled from a roll 2. For this purpose the axis 4 of roll 2 is mounted on a diagonal roll guide 5, the paper web 3 is unrolled via roll 6, generally driven and functioning as a brake, being in contact with roll 2 at the circumference, two withdrawal rolls 7 and 8 with differential transmissions pull paper web 3 off with a known selectable or regulatable speed. This determines the speed of the paper web. The register of the web is determined by read-head 26 and supplied to a control unit 19 as a reference value. Then paper web 3 passes through a web edge control 9 that allows additional processing of paper web 3 with exact lateral registration.

As can be seen in FIGS. 2 and 3, paper or foil webs 3*a*, 3*b*, and 3*c* are unrolled from a plurality of such pay-out units 1*a*, 1*b*, and 1*c* located side by side. The individual webs pass turning crosses 10*a*, 10*b*, and 10*c*, where they are guided over deflection rolls 13*a*, 13*b*, and 13*c* and each successive web comes to rest beneath the previous web(s). Then they are fed to a processing line 11.

In processing line 11, the three unrolled webs 3*a*, 3*b*, and 3*c* are processed either jointly or independently of one another, depending on the desired processing steps. Thus for example numbering machines, printing media (such as ink-jet or laser printers), multiflex units, "Abheftlochstationen*" or even rotary feeders can be provided for applying packets. Transmission boxes 12 are provided for each of these freely locatable intermediate modules, said boxes each being provided with a 360° register. The paper webs do not have to be guided by toothed belts in processing line 11, as is known from the prior art, but are freely tensioned in this area and, depending on the intermediate modules to be provided, are guided over deflection rollers. Nevertheless, however, especially since independent processing of the individual paper webs is possible in the processing unit, toothed belt guidance can be provided if desired for at least one of the paper webs.

*Literally: stapling-perforating stations. Translator.

One web for example, which is moistened in the processing line, is stretched as a result. In order to compensate for this effect, the web is guided over intermediate rolls or around additional cylinders in order to maintain the desired tension.

After passing through the processing line 11, webs 3*a*, 3*b*, and 3*c* are guided between two powered rubber cylinders 14*a* and 14*b* and fed to a unit 15 for further processing. In the known units for processing and further processing, "Zuggruppen*" generally designed as mechanical press rolls, are provided downstream from the pay-out unit. Downstream from the processing line and upstream from the unit for further processing, no additional "Zuggruppen" can be provided. Guide rolls located upstream from the unit for further processing, and possibly regulatable, as stated at the outset, serve in known devices for correcting the web register but not for creating a certain web tension.

*Literally, pulling groups. Translator.

It is possible on the other hand by using rubber cylinders 14*a* and 14*b* upstream of unit 15 for further processing, to develop a paper tension that is uniform across the width of the web and to have control over it. Rubber sheaths with different profiles can be pulled over the rolls and thus adapted to different processing procedures. Thus for example recesses can be provided on these rubber cylinders, into which, by means of a card dispenser provided in the processing line, plastic cards glued to one of the webs, or sample packets applied by means of a rotary feeder, fit. As a result, the pressure on all of the webs that have been brought together at this point will remain uniform over the width of the web. These rubber cylinders 14*a* and 14*b* are driven, essentially synchronously with the *Druckbildabwicklung*". The paper webs are therefore pulled and kept stretched across processing line 11. The basic setting is then made on the basis of a check of the superimposed paper webs by the operating personnel while the ongoing corrections during the processing procedure are performed with the regulating devices described below.

*Literally: printing-image unwinding. Translator.

In addition, further pairs of withdrawal rolls can be provided, likewise preferably designed as rubber cylinders. Such an arrangement is advantageous when products consisting of many layers are involved, since when several paper webs are combined, air cushions remain between the individual webs, especially the innermost ones, that can produce undesired modulations in the individual registers. For this purpose, at least two pairs of withdrawal rolls should be mounted one behind the other so that variations caused by air cushions can be compensated thereby. However, pairs of withdrawal rolls can also be provided as well between certain processing assemblies or units in the processing line, which may prove advantageous especially on long processing lines in order to keep the tension constant over the length of the processing line.

In general, rolls with a standard circumference of 24 inches (60.96 cm) are used as withdrawal rolls. Both cylinder rolls 14*a* and 14*b* of the pair of withdrawal rolls are driven, and they are driven synchronously, so that the same circumferential speed is obtained. The axes of the two cylinders 14*a* and 14*b* are aligned exactly with respect to one another and are perpendicular to the paper transport direction. Thus the pressure exerted by the pair of withdrawal rolls on the paper webs located between them is constant and the paper webs are transported in a straight line without the slightest wrap angle.

It is obvious that, for example as a function of the material or the flexibility of the sheaths of the withdrawal rolls, the circumferential speed of these withdrawal rolls must be adapted to the respective thickness of the paper web(s) guided in between.

On the basis of available information on the registration of the markings, the circumferential speed of the withdrawal roll(s) can be modified as well. For this purpose, by means of control unit 19, a servoregulator 22*d* for operating a servomotor 20*d* on transmission 21*d* of the withdrawal rolls, preferably designed as rubber cylinders 14*a* and 14*b*, is controlled. This ensures that the paper webs in the adjoining unit 15 for further processing can be processed exactly in register. However, the correct positioning of the units of processing unit 11 can be adjusted in this way. Similarly (not shown) the transmissions of intermediate modules 12 can be controlled by control unit 19.

A main drive 23 is provided for driving withdrawal rolls 7 and 8, driving intermediate modules 12, rubber cylinders 14*a* and 14*b*, and the individual stations in unit 15 for further processing.

Unit 15 for further processing can be for example a cutting, perforating, or stapling unit. The distance between rubber cylinders 14*a* and 14*b* and unit 15 for further processing should generally be as small as possible since, looking in the direction of web travel, paper tension is no longer maintained downstream from rubber cylinders 14*a* and 14*b*. The finished products are then delivered to a delivery table 16 or possibly to additional processing as for example a bookbinding machine or a folder.

Downstream from turning crosses 10*b* and 10*c*, looking in the direction of web travel, a web feeler 17*b* or 17*c* is provided for the second and third paper webs respectively, while an additional web feeler 18 is located immediately upstream of rubber cylinders 14*a* and 14*b*. This arrangement of web feelers 18 directly in front of cylinders 14*a* and 14*b*, in other words, in front of the last of the withdrawal roll pairs, is generally advantageous since the paper webs, in the following unit for further processing, are no longer under tension, possibly because of the processing that takes place at this point, and possibly have a slight tendency to flutter, and the reading of the register marks becomes uncertain. Paper webs 3*a*, 3*b*, and 3*c* have markings that are applied at certain and equal intervals. Depending on the nature of the web feeler, the type of marking is selected, thus for example, line marks that can be picked up by photosensors.

When the first marking is registered on the first and uppermost paper web 3*a* by web feeler 18, a signal is available from this web feeler 18 that is fed to a control unit 19.

If the operating personnel determine that the longitudinal registration is correct, a reference value is then available that reproduces the desired web speed and permits longitudinal register control of the uppermost web relative to unit 15 for further processing or relative to the individual modules of processing unit 11 (the time sequence of the signals available from web feeler 18 is therefore critical).

Since the tension of paper web 3*a* is generated by the two rubber cylinders 14*a* and 14*b*, the latter must always run at a slightly higher circumferential speed than the actual web speed desired would require. In order to ensure the necessary longitudinal register, the signals available from web feeler 18 are constantly compared in control unit 19 with a reference value.

If the actual value varies, control unit 19, possibly with zero contact, controls a servoregulator 22*a* to operate a servomotor 20*a* on differential transmission 21*a* of withdrawal rolls 7*a* and 8*a* on pay-out unit 1*a*. This makes it possible to hold back paper web 3*a* slightly, to brake it so to speak.

Thus, the paper tension is alternately developed and also monitored by the two rubber cylinders 14*a* and 14*b*.

The other paper webs 3*b* and 3*c* must also be registered exactly lengthwise, jointly with first web 3*a*, since these three webs, independently of their possibly different processing, are processed jointly in unit 15 for further processing.

When the second paper web 3*b*, after passing through helical crosses lob, passes web feeler 17*b*, the latter will register the marks and send signals to control unit 19. Exact longitudinal register of paper web 3*b*, specifically on upper paper web 3*a*, is achieved when the marks of the two paper webs are congruent at the location of web feeler 18. The distance traveled by second paper web 3*b* between web feeler 17*b* and web feeler 18 is known, and a certain pulling force is exerted on the two webs because of the pressure exerted by the two rubber cylinders 14*a* and 14*b* on the two paper webs 3*a* and 3*b*. Thus, from the time sequence of the signals obtained from web feeler 17*b*, a determination can be made as to whether paper web 3*b* is in correct register.

In accordance with the regulation described for paper web 3*b*, the regulation processes for paper web 3*b* are also performed. A servoregulator 22*b* for operating a servomotor 20*b* is controlled through control unit 19 on differential transmission 21*b* of withdrawal rolls 7*b* and 8*b* at pay-out unit 1*b*.

The exact longitudinal register is also regulated for the third paper web 3*c* in the same way. For this purpose, web feeler 17*c* is provided, whose signal directly controls a servoregulator 22*c* for operating a servomotor 20*c* on differential transmission 21*c* of withdrawal rolls 7*c* and 8*c* on pay-out unit 1*c*.

After passing rubber cylinders 14*a* and 14*b*, the combined paper webs 3*a*, 3*b*, and 3*c* are processed further; the paper webs are generally no longer tensioned at this point. Therefore, in order to maintain the congruence of the webs, the unit for further processing should be located as close as possible to rubber cylinders 14*a* and 14*b*.

Optionally, a web feeler 17*a* associated with the uppermost paper web can be provided, with which, as already described above, an additional or alternative register monitoring or control for the uppermost paper web 3*a* is possible.

Within processing line 11, means for monitoring the individual registers can be provided as well in known fashion.

In conjunction with helical crosses 10*a*, 10*b*, and 10*c*, guide rolls 27 (represented by dashed lines in FIGS. 2*b* and 3*b*) can be provided that are possibly also driven and essentially serve to guide the paper but not to pinch it. In the latter case, a withdrawal group, possibly of traditional design, is provided for correct register for each of the webs.

What is claimed is:

1. A device for combining and processing at least two paper or foil webs with at least two pay-out units, in each of which a paper web provided with markings applied at regular intervals, are pulled off by at least one withdrawal roll from a roll and, optionally guided over deflection rollers, are combined with the at least second paper web and fed to a processing line in which the at least two paper webs, optionally independently of one another, pass through processing units and are supplied to a unit for further processing, wherein means are provided for congruent longitudinal register control of the at least two paper webs, comprising the following parts:

means for producing a paper tension that is the same—essentially constant—for each individual of the at least two paper webs over its width;

a plurality of web feelers for registering the time sequence of the markings on each paper web; and a control unit for controlling a drive or brake device.

2. The device according to claim 1, wherein at least one withdrawal roll pair is provided as means for producing the paper tension, said roll pair being located downstream from said processing line.

3. The device according to claim 2, wherein a web feeler is provided in the vicinity of the withdrawal roll pair, immediately upstream of the latter looking in the direction of web travel, while a second web feeler is provided for every paper web that is not uppermost is provided upstream of said processing line and in particular is located immediately upstream of the combination with the at least second paper web.

4. The device according to claim 2, wherein the circumferential speed of the withdrawal roll pair can be regulated by the control unit.

5. The device according to claim 2, wherein said roll pair comprises at least two rubber rolls.

6. The device according to claim 2, wherein said roll pair is directly upstream of said unit for further processing.

7. The device according to claim 6, wherein said rubber rolls are provided on their circumference with a profile for receiving corresponding processing products.

8. The device according to claim 6, wherein the axes of said rubber rolls are aligned on one another and in a plane perpendicular to the direction of web travel of the paper webs.

9. The device according to claim 1, wherein the unit for further processing directly abuts the withdrawal rolls.

10. The device according to claim 1, wherein said drive or brake device is associated with the at least one withdrawal roll.

11. A method for combining and processing at least two paper webs, each provided with markings applied at regular intervals for registering a time sequence, being pulled off in a pay-out unit by means of at least one withdrawal roll from a roll and possibly guided over deflection rollers, whereupon the at least two paper webs are combined and fed to a processing line in which they pass through processing units, possibly independently of one another, and are fed to a unit for further processing, characterized in that an essentially constant paper tension is built up across the web width of each of the at least two webs, and that the time sequence of the marks on each paper web is registered, said registration being fed in the form of signals to a control unit, compared with a preset reference value, and serving to control a drive or braking device.

12. The method according to claim 11, wherein said paper webs are each kept under tension at least up to the end of said processing line.

* * * * *